US007667117B2

(12) United States Patent
Wasser et al.

(10) Patent No.: US 7,667,117 B2
(45) Date of Patent: Feb. 23, 2010

(54) MUSICAL INSTRUMENT PISTON VALVE

(75) Inventors: Steven Wasser, Wellesley, MA (US); Clifford Blackburn, Decatur, TN (US)

(73) Assignee: Verne Q. Powell Flutes, Inc., Maynard, MA (US)

( * ) Notice: Subject to any disclaimer, the term of this patent is extended or adjusted under 35 U.S.C. 154(b) by 603 days.

(21) Appl. No.: 11/098,340

(22) Filed: Apr. 4, 2005

(65) Prior Publication Data

US 2006/0219083 A1 Oct. 5, 2006

(51) Int. Cl.
*G10D 7/10* (2006.01)
*G10D 9/04* (2006.01)

(52) U.S. Cl. ..... 84/144; 84/387 R; 84/388; 84/391; 84/392

(58) Field of Classification Search ..... 84/388, 84/392
See application file for complete search history.

(56) References Cited

U.S. PATENT DOCUMENTS 911,637 A 2/1909 Adkins
1,367,386 A 2/1921 Hawkins
2,149,714 A 3/1939 Wornell
2,404,818 A * 7/1946 Swinehart ..... 84/392
2,511,255 A 6/1950 George
3,044,339 A * 7/1962 Greenleaf ..... 84/392
3,911,784 A * 10/1975 Shiono ..... 84/392
3,973,464 A * 8/1976 Novy ..... 84/392
3,990,342 A 11/1976 Reeves

* cited by examiner

*Primary Examiner*—Jeffrey Donels
*Assistant Examiner*—Christopher Uhlir
(74) *Attorney, Agent, or Firm*—Iandiorio Teska & Coleman

(57) ABSTRACT

A musical instrument piston valve receivable in a valve casing. The valve includes a valve stem, a valve barrel connected to the valve stem, and a valve guide slidably disposed with respect to the valve barrel. A spring is disposed in the valve barrel extending between the valve stem and the valve guide. A piston extends from the valve barrel and includes one or more ports. There are also various ways of adjusting the angular orientation of the piston in the valve casing. It is preferred that the piston and the valve barrel are monolithic in construction and the piston valve includes an adjustable valve guide.

4 Claims, 11 Drawing Sheets

MUSICAL INSTRUMENT PISTON VALVE

FIELD OF THE INVENTION

This subject invention relates to a musical instrument piston valve for wind instruments including, but not limited to, trumpets, comets, tenor horns, valve trombones, French horns, and tubas.

BACKGROUND OF THE INVENTION

The piston valve in a musical instrument such as a trumpet is pushed down to change the note played. A typical trumpet has three valve casings each with a piston valve assembly. Each valve casing is connected to a valve slide. If the piston valve is in the up position, the air through the trumpet will take the shortest possible path through one port in the piston valve. When the piston valve is pushed down, the air is diverted through a different port in the piston valve, around the valve slide, and back out through another port in the piston valve.

A typical top spring piston valve assembly inserted into a valve casing includes a finger button on top of a valve stem the distal end of which is fastened to a valve barrel also called a spring barrel, sleeve, baluster, or spring case section. A separate piston with air ports is soldered to the valve barrel. A spring in the valve barrel in combination with a valve guide or "star" biases the entire piston valve assembly (and the finger button) in the up position.

Specifically, the valve guide, washer-like in construction, is adapted for sliding engagement with longitudinal opposing guide slots in the valve barrel as the spring in the valve barrel is compressed. Thus, when the finger button is pushed down, the stem, the valve barrel, and the piston move down as a unit. The valve guide remains stationary since it is fixed vertically with respect to a ridge (also called a seat, ledge, shelf, or shoulder) in the valve casing. The button, stem, valve barrel, and piston are biased upward due to the compression of the spring between the valve guide and the valve stem. The valve guide, by cooperating with grooves and the ridge in the valve casing, also orients the entire piston valve assembly both radially and longitudinally in the valve casing most notably to correctly orient the ports in the piston portion of the valve with the trumpet slides.

Those skilled in the art have attempted to provide tension adjustment for the spring in the valve barrel. See U.S. Pat. Nos. 2,149,714 and 1,367,386. U.S. Pat. No. 3,990,342 discusses up stroke and down stroke adjustment of a piston valve. U.S. Pat. No. 2,511,255 shows a self lubricating piston valve. All of these patents are incorporated herein by this reference.

The alignment of the valve piston ports to the slides, however, has always been problematic. Valves are not made to consistently high tolerances and often slides are not positioned to consistently high tolerances either. Valve radial position inaccuracy can also easily occur during the soldering operation when the valve barrel is soldered to the valve piston. If the tooling used is worn, or if the heat of the soldering operation causes part movement, the result can be an inaccurately placed valve. Indeed, many brass instrument owners send their instruments, both old and new, to specialists for a "valve alignment job". These specialists attempt to determine by how much each valve is misaligned. To correct radial misalignment they then unsolder the valve barrel from the piston and solder the two parts back together in a position where the craftsman believes the alignment will be correct. Since there is no practical way to easily measure the precise amount of radial misalignment, the repositioning of the valve barrel to the piston is not always correct and the valve alignment process may need to be repeated. Vertical realignment is accomplished by changing rubber and felt washers.

Valves are also costly to make. In order to manufacture the valve, one machining operation has to be performed to make the valve barrel, and a separate machining operation has to be performed to make the piston. As indicated above, the two parts then have to be soldered together in what is typically a manual operation.

SUMMARY OF THE INVENTION

It is therefore an object of this invention to minimize the costs, assembly requirements, and machine operations associated with manufacturing a piston valve assembly for wind instruments such as trumpets.

It is a further object of this invention to better ensure constant and accurate location of the piston ports relative to the valve casing and the slide.

It is a further object of this invention to reduce the need for a valve alignment job.

It is a further object of this invention to provide an adjustable valve guide to account for any radial misalignment due to inaccuracy in slide positions.

The subject invention results from the realization that an easier to manufacture and more consistently accurate piston valve assembly is effected by machining both the valve head and the piston from one piece of stock material and that any radial misalignment due to slide inaccuracy can be accommodated by a novel adjustable valve guide.

The subject invention, however, in other embodiments, need not achieve all these objectives and the claims hereof should not be limited to structures or methods capable of achieving these objectives.

This subject invention features a musical instrument piston valve receivable in a valve casing. The typical valve includes a valve stem, a valve barrel connected to the valve stem, and a valve guide slidably disposed with respect to the valve barrel. A spring in the valve barrel extends between the valve stem and the valve guide. A piston extends from the valve barrel and includes one or more ports. There are also means for adjusting the angular orientation of the piston in the valve casing.

In one preferred embodiment, the piston and the valve barrel are monolithic in construction and the means for adjusting includes a novel adjustable valve guide.

One adjustable valve guide includes at least one valve casing key extending therefrom for setting the radial orientation of the piston in the valve casing and at least one extending stop member for setting the longitudinal orientation of the piston in the valve casing. Typically the casing key is adjustable with respect to the stop member.

In one example, the adjustable valve guide includes a first plate including the valve casing key and a second plate including the stop member and a fastener allowing adjustment of the first plate relative to the second plate and for fixing the first plate to the second plate when the piston is correctly aligned in the valve casing. Typically, the first plate includes a threaded hole therein, the second plate includes a clearance hole therethrough, and the fastener has a head seated on the second plate, and a shaft extending through the clearance hole and into the threaded hole of the first plate for tightening and untightening the fastener through the valve head.

In another example, the casing key includes a threaded hole therein, the stop member includes a clearance hole therethrough, and there is a fastener with a head seated on the stop member and a shaft extending through the clearance hole and into the threaded hole to adjust the key relative to the stop member.

In another example, the casing key is initially adjustable relative to the stop member and adhearable to the stop member after alignment of the piston in the casing. In another embodiment, the means for adjusting includes a valve guide with a width adjustable key. In one example, the key includes an adjustable fastener extending outward from the key. In another example, at least one shim can be disposed between the key and a key receiving slot in the valve casing.

In another embodiment, the means for adjusting includes a selection of valve guides each with a valve guide key oriented differently with respect to a stop member. Typically, one valve guide includes a key centered with respect to the stop member, one valve guide includes a key offset in one direction with respect to the stop member, and one valve guide includes a key offset in the opposite direction with respect to the stop member.

In another embodiment, the adjustable valve guide includes at least one casing key extendable and retractable radially.

In still another embodiment, the valve barrel is rotatable with respect to the piston. Typically, the valve barrel includes a clearance hole adjacent the piston, the piston includes a threaded hole adjacent the valve barrel, and the means for adjusting includes a fastener received through the clearance hole and into the threaded hole to secure the valve barrel to the piston in a predetermined angular orientation of the piston with respect to the valve barrel.

The subject invention also features a musical instrument piston valve with a valve barrel and a piston extending from the valve barrel including one or more ports. The piston and valve head are monolithic in construction and machined from one piece of stock material. There may optionally be means for adjusting the angular orientation of the piston in a valve casing such as an adjustable valve guide.

An adjustable valve guide for a musical instrument piston valve in accordance with the subject invention may include at least one casing key extending from the valve guide for setting the radial orientation of the piston in the valve casing and at least one extending stop member for setting the longitudinal orientation of the piston in the valve casing. There are means for adjusting the casing key adjustable relative to the stop member.

In one example, the means for adjusting includes a first plate including the valve casing key and a second plate including the stop member and a fastener allowing adjustment of the first plate relative to the second plate and for fixing the first plate to the second plate when the piston is correctly aligned in the valve casing. Typically, the first plate has threaded hole therein, the second plate includes a clearance hole therethrough, and the fastener has a head seated on the second plate, and a shaft extending through the clearance hole and into the threaded hole of the first plate for tightening and untightening the fastener through the valve head.

In another example, the means for adjusting includes a casing key with a threaded hole therein, the stop member includes a clearance hole therethrough, and there is a fastener with a head seated on the stop member and a shaft extending through the clearance hole and into the threaded hole to adjust the key relative to the stop member. In still another example, the casing key is initially adjustable relative to the stop member and adhearable to the stop member after alignment of the piston in the casing.

One embodiment of the means for adjusting is a valve guide with a width adjustable key. In one example, the key includes an adjustable fastener extending outward from the key. In another example, there is at least one shim to be disposed between the key and a key receiving slot in the valve casing.

In another embodiment, the means for adjusting includes a selection of valve guides each with a valve guide key oriented differently with respect to a stop member. Typically, one valve guide includes a key centered with respect to the stop member, one valve guide includes a key offset in one direction with respect to the stop member, and one valve guide includes a key offset in the opposite direction with respect to the stop member.

In another embodiment, the means for adjusting includes at least one casing key extendable and retractable radially.

One method of making a musical instrument piston valve in accordance with this invention features machining cylindrical tube stock to define a valve barrel and a piston including one or more ports resulting in a monolithic one piece valve barrel/piston assembly with the ports correctly aligned with respect to the valve head. The method may further include fabricating an adjustable valve guide and disposing said adjustable valve guide in the valve barrel of the piston valve.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
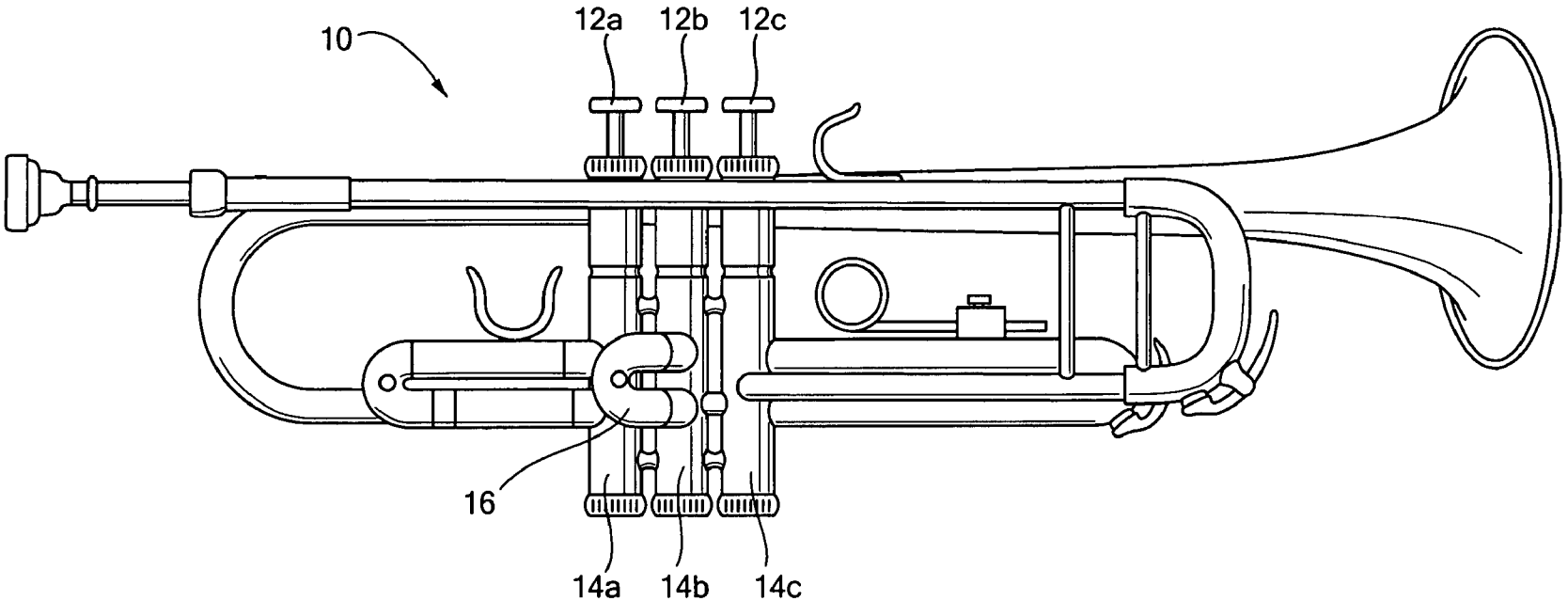
FIG. 1 PRIOR ART
FIG. 1 is a schematic front view of a trumpet.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Specifically, the following disclosure relates to a trumpet valve but the subject invention has applicability to other wind instruments and other types of valves. Moreover, the claims hereof are not to be read restrictively unless there is clear and convincing evidence manifesting a certain exclusion, restriction, or disclaimer.

Figure 2:
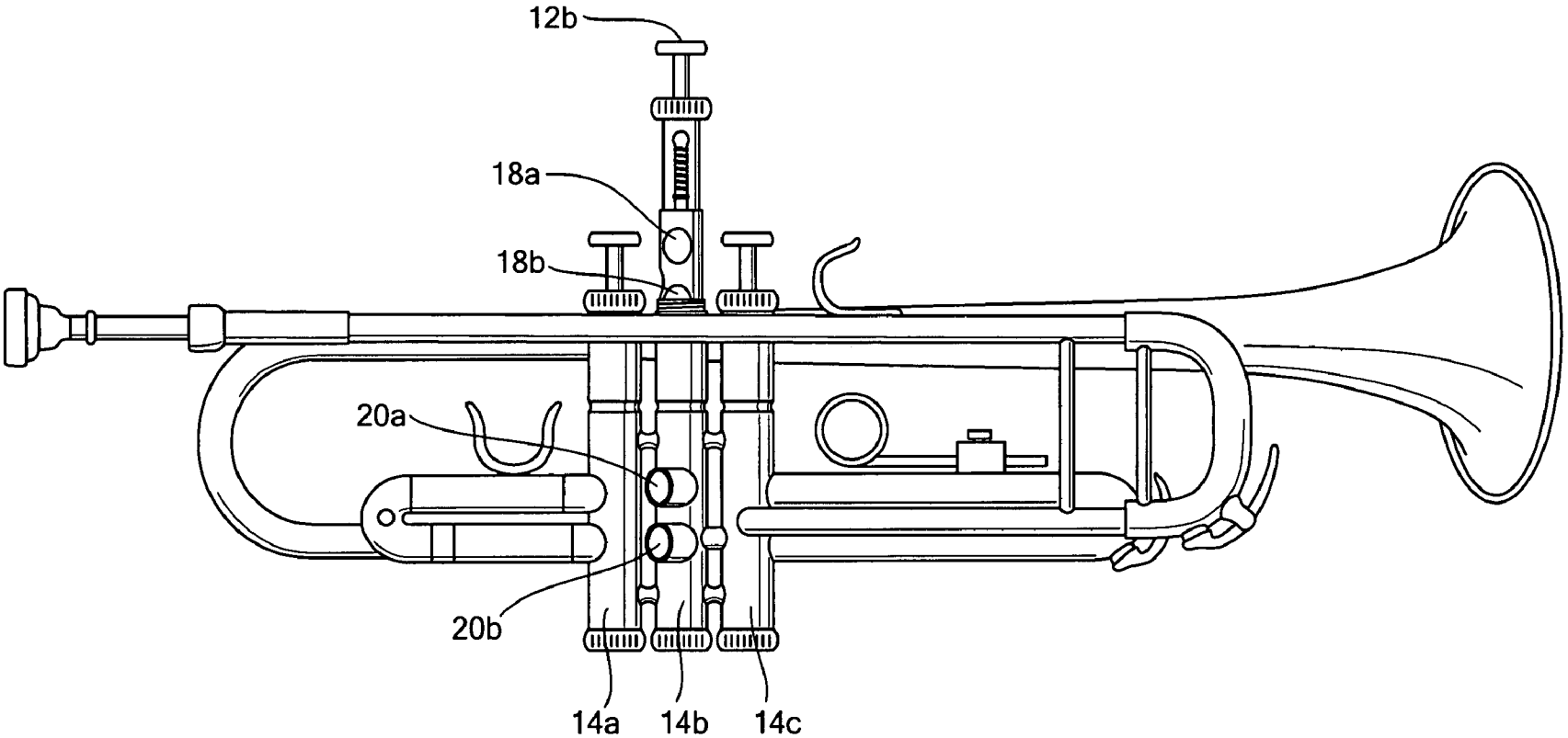
FIG. 2 PRIOR ART
FIG. 2 is a schematic front view showing the removal of a piston valve from the trumpet shown in FIG. 1.

FIG. 1 shows trumpet 10 with three piston valves 12*a*, 12*b*, and 12*c* installed in their respective casings 14*a-c*. Slide 16 is associated with second valve 12*b*. FIG. 2 shows the second valve 12*b* being removed and the slide 16 of FIG. 1 already removed. As explained in the background of the invention above, valve 12*b* is preferably both vertically and radially positioned in casing 14*b*, FIG. 2 so that ports 18*a* and 18*b* are correctly aligned with slide ports 20*a* and 20*b*.

Figure 4:
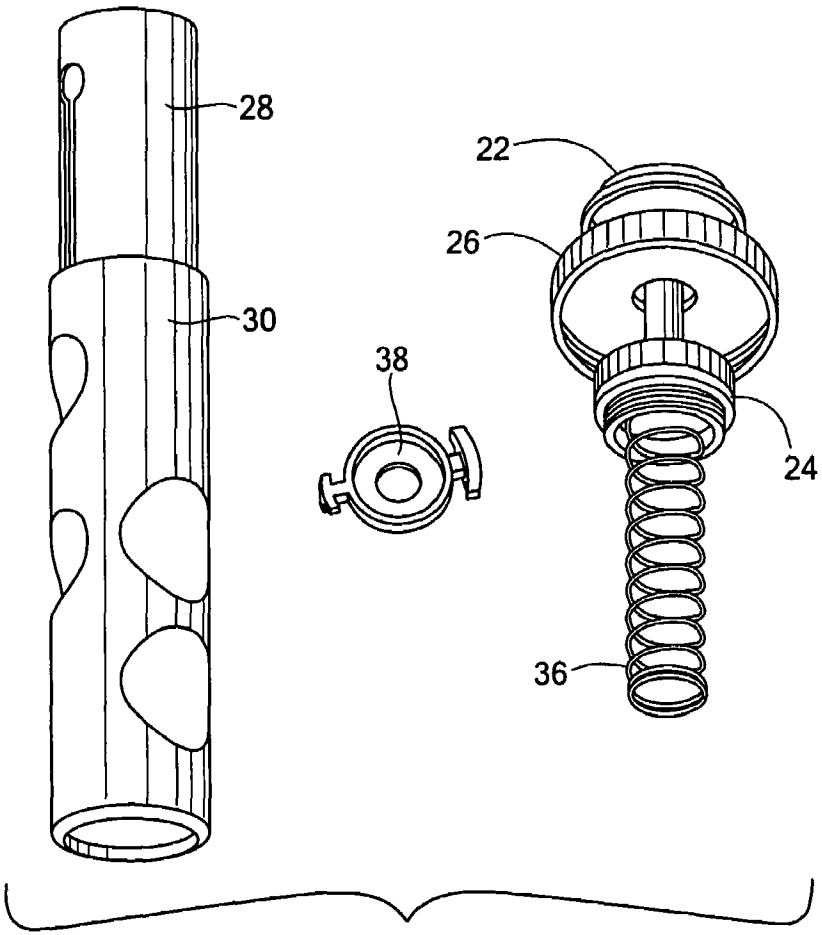
FIG. 4 PRIOR ART
FIG. 4 is a schematic three-dimensional view showing the primary components associated with a typical piston valve assembly.
Figure 3:
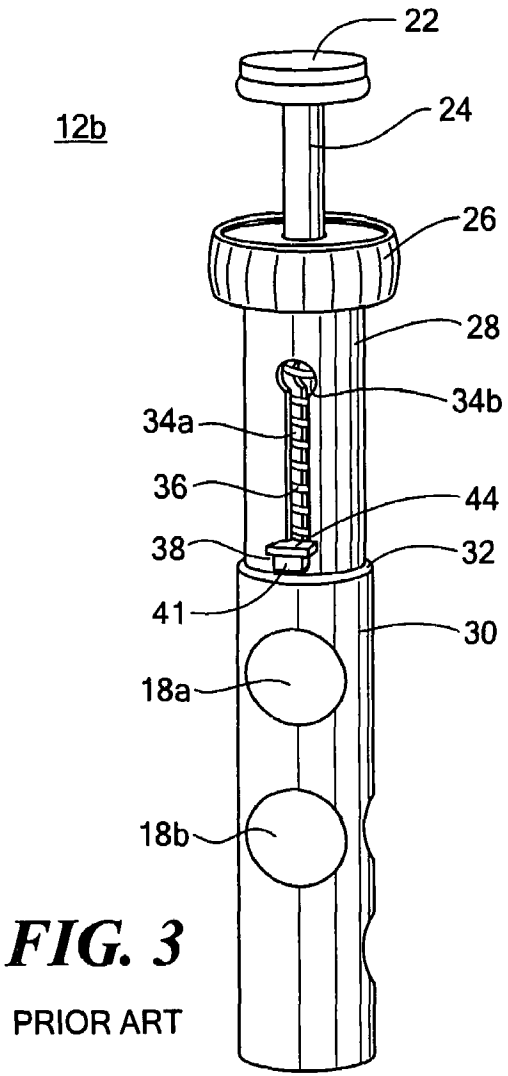
FIG. 3 PRIOR ART
FIG. 3 is a schematic three-dimensional front view of a typical piston valve assembly.
Figure 5:
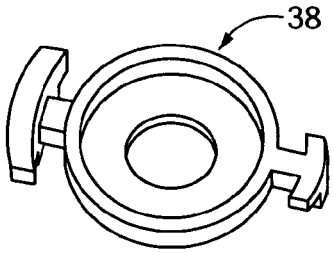
FIG. 5 PRIOR ART
FIG. 5 is a schematic three-dimensional top view of a prior art valve guide.
Figure 6:
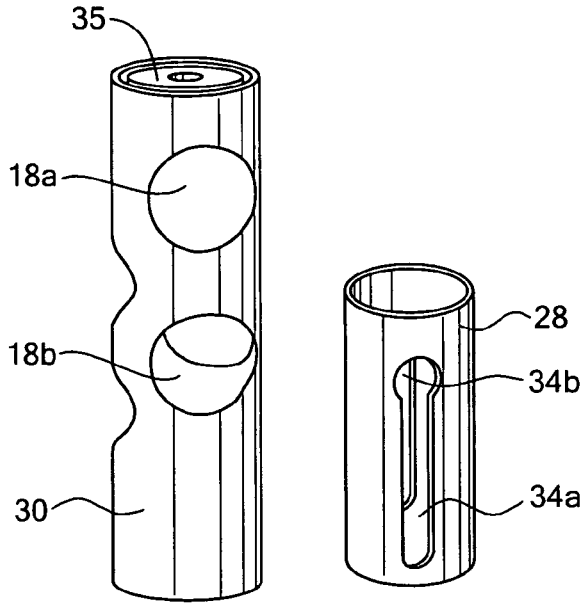
FIG. 6 is a schematic three-dimensional front view showing a valve piston de-soldered from a valve barrel during a valve alignment job.
Figure 7:
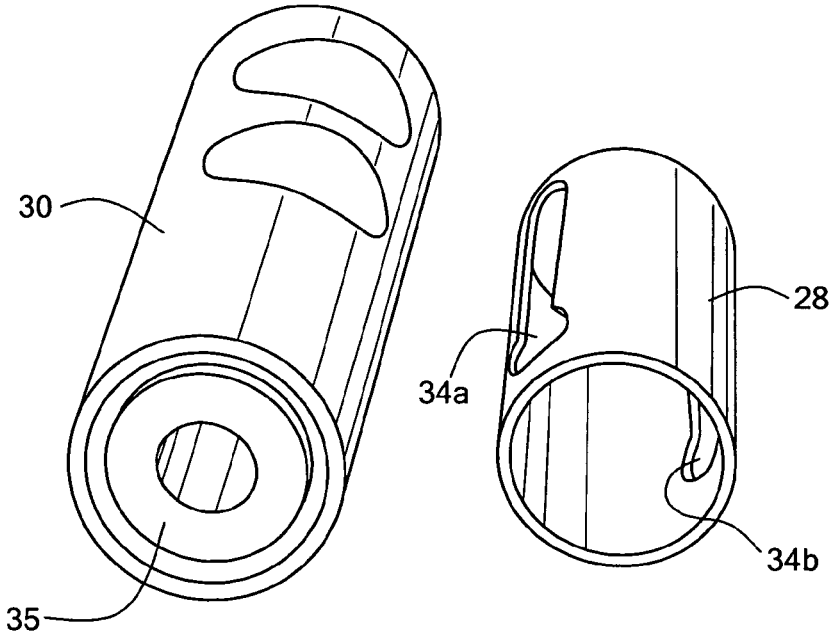
FIG. 7 PRIOR ART
FIG. 7 is a schematic three-dimensional top view of the piston and valve barrel shown in FIG. 6.
Figure 9:
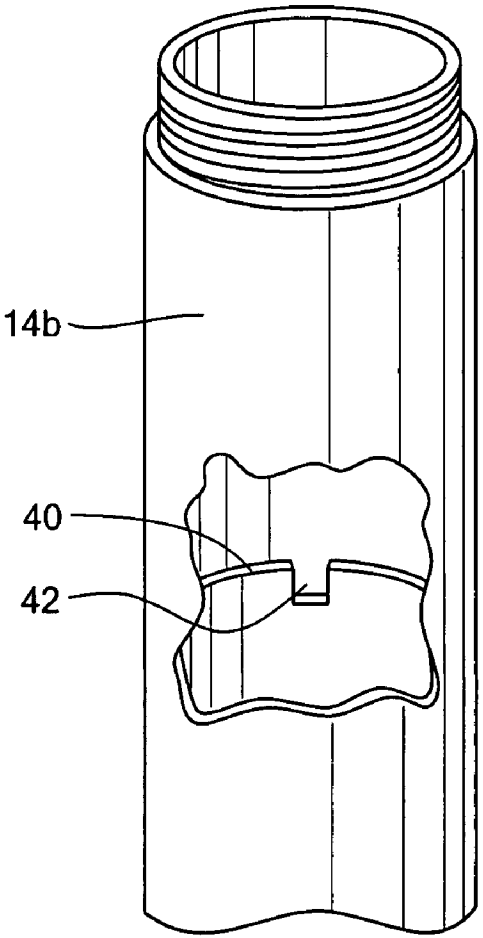
FIG. 9 is a schematic three-dimensional partially broken away view of a typical valve casing.
Figure 8:
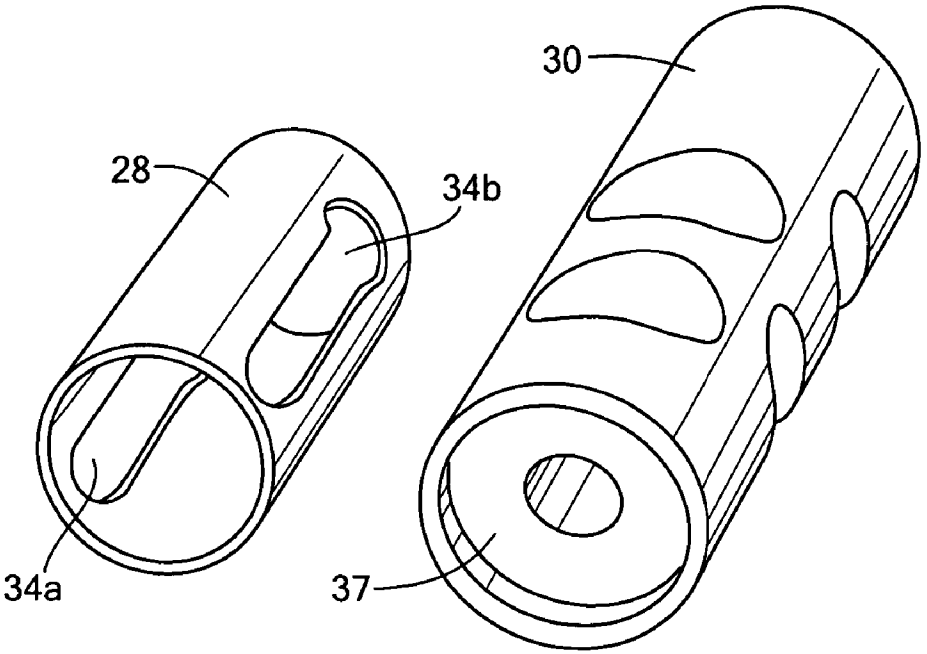
FIG. 8 PRIOR ART
FIG. 8 is a schematic three-dimensional bottom view of the piston and valve barrel shown in FIG. 6.

FIG. 3 shows valve 12*b* including finger button 22, valve stem 24, top valve cap 26, valve barrel 28, and piston 30 including ports 18*a* and 18*b*. Valve barrel 28 is soldered to piston 30 at joint 32. Valve barrel 28 includes opposing longitudinal guide slots 34*a* and 34*b*. Valve barrel 28 includes therein spring 36 extending between valve stem 24 and slidable valve guide 38 which includes valve casing key 41 and stop member 44. FIG. 4 shows valve barrel 28 soldered to piston 30, valve guide 38, spring 36, valve stem 24, top valve cap 26, and button 22. FIG. 5 shows valve guide 38 alone and FIGS. 6-8 show, from various perspectives, valve barrel 28 now de-soldered from piston 30 for alignment. FIGS. 6-7 also show piston top end cap 35 and FIG. 8 shows piston bottom end cap 37. FIG. 9 shows valve casing 14*b* with ledge 40 on which rests stop member 44, FIG. 3 of valve guide 38 and slot 42, FIG. 9 which receives key 41, FIG. 3 of valve guide 38.

As explained in the background section above, valve guide 38, FIG. 3 is adapted for sliding engagement within longitudinal opposing guide slots 34*a* and 34*b* in valve barrel 28 as spring 36 is compressed. Thus, when finger button 22 is pushed down, button 22, stem 24, valve barrel 28, and piston 30 move down in the valve casing as a unit. Valve guide 38 remains stationary since it is fixed vertically with respect to ridge 40, FIG. 9 in valve casing 14*b*. The button, stem, valve barrel, and piston are biased upward due to the compression of spring 36 extending between valve guide 38 and stem 24. Valve guide 38, by cooperating with ridge 40 and groove 42, FIG. 9 also orients the entire piston valve assembly both radially and longitudinally in the valve casing most notably to correctly orient the ports of the piston with the trumpet slides.

As also noted in the background section above, the alignment of the valve piston ports to the slides has always been problematic. Valves are not made to consistently high tolerances and often the slides are not positioned to consistently high tolerances either. Valve radial position inaccuracy can also easily occur during the soldering operation when the valve barrel is soldered to the valve piston. If the tooling used is worn, or if the heat of the soldering operation causes part movement, the result can be an inaccurately placed valve. Indeed, many brass instrument owners send their instruments, both old and new, to specialists for a "valve alignment job". These specialists attempt to determine by how much each valve is misaligned radially. They then unsolder the valve barrel from the piston as shown in FIGS. 6-8 and then resolder the two parts back together in the position where the craftsman believes the alignment will be correct. Since there is no practical way to easily measure the precise amount of misalignment, the repositioning of the valve barrel to the piston is not always correct and the valve alignment process may need to be repeated. Thus, this process is costly and an inconvenience to the owner of the musical instrument.

Valves are also costly to make. In order to manufacture the valve, one machining operation has to be performed to make the valve barrel, and a separate machining operation has to be performed to make the piston. As indicated above, the two parts then have to be soldered together in what is typically a manual operation.

Figure 10:
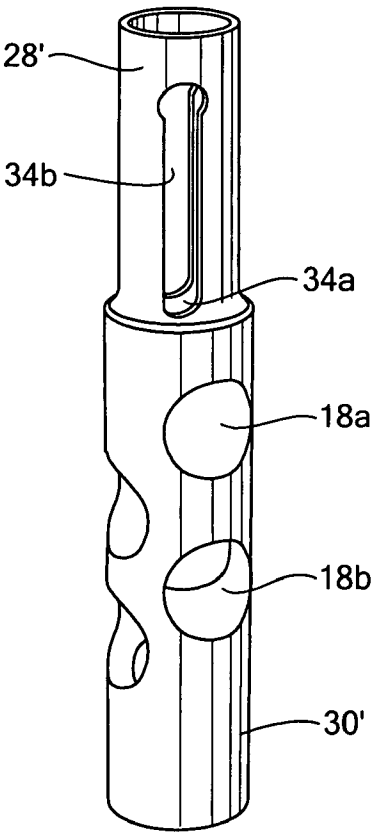
FIG. 10 is a schematic three-dimensional front view of a monolithic valve barrel and piston in accordance with the subject invention.

In sharp contrast, in accordance with the subject invention, piston 30', FIG. 10 and valve barrel 28 are monolithic in construction. Instead of machining the valve barrel and the piston separately and then soldering them together resulting in possible misalignment, monolithic piston 30' and valve barrel 28' are machined (e.g., using a CNC machine) from a single piece of cylindrical tube stock material (e.g., brass, monel, or stainless steel) to define valve barrel 28' with guide slots 34*a* and 34*b* and piston 30' with ports 18*a* and 18*b* resulting in a piston always perfectly aligned with the valve barrel, low manufacturing costs, and an acoustically superior valve. The top and bottom caps of the piston are secured thereto as known in the art and the piston ports are then formed as is also known in the art. Then, the other valve assembly components shown in FIGS. 3-5 are installed as is conventional.

For minor or even major radial alignment of this new valve assembly in the casing due to slide position errors or the like, the monolithic structure of FIG. 10 cannot be de-soldered as in the prior art. So, the subject invention also features various means for adjusting the angular orientation of the piston 30' in a valve casing.

Figure 11:
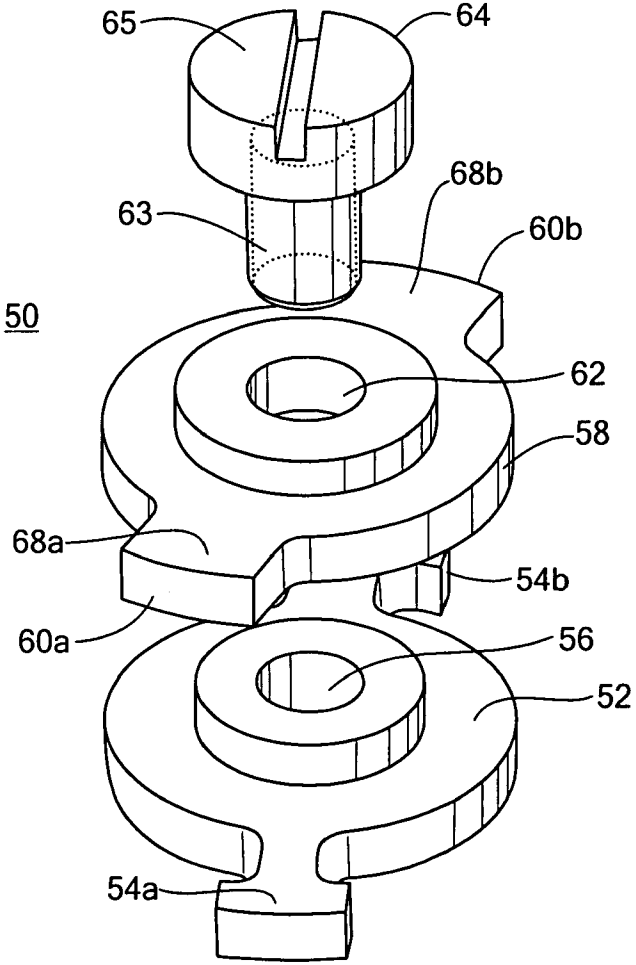
FIG. 11 is a schematic three-dimensional front view showing one embodiment of an adjustable valve guide in accordance with the subject invention.

In one embodiment, the means for adjusting includes adjustable valve guide 50, FIG. 11. Adjustable valve guide 50 includes first plate 52 with valve casing keys 54*a* and 54*b* extending therefrom and threaded hole 56. The valve casing keys set the radial orientation of the valve in the casing. Second plate 58 includes stop members 60*a* and 60*b* extending therefrom and clearance hole 62. The stop members set the radial orientation of the piston in the valve casing. Shaft 63 of fastener 64 (e.g., a screw) is received through clearance hole 62 in top second plate 58 and is threaded into threaded hole 56 in bottom first plate 52 to secure top plate 58 to bottom plate 52 in a way which allows angular adjustment of the keys 54*a* and 54*b* relative to stop members 60*a* and 60*b*. Head 65 of fastener 64 sits on top plate 58. In this way the valve can thus be adjusted in-situ in the casing with a screwdriver used to loosen screw 64 in combination with a fixture used to align the piston ports relative to the slide. One example of a suitable fixture includes a tool which is basically an expandable ball on a flexible shaft, inserted through the slide port and into the piston port to position the piston port relative to the slide port. Thereafter, screw 64 tightened securing top plate 58 to bottom plate 52 with keys 54*a* and 54*b* locked into opposing slots (see slot 42, FIG. 9) in a position relative to stop members 60*a* and 60*b*, FIG. 11 resting on casing ledge 40, FIG. 9 such that the piston ports are correctly aligned with the slide.

Preferably, the width of keys 54*a* and 54*b*, FIG. 11 is narrower or approximately the same as the width of slots 34*a* and 34*b*, FIG. 10 in barrel 28' while the width of arms 68*a* and 68*b*, FIG. 11 of top plate 58 is wider. In one alternative embodiment, stop members 60*a* and 60*b* can be eliminated.

Figure 12:
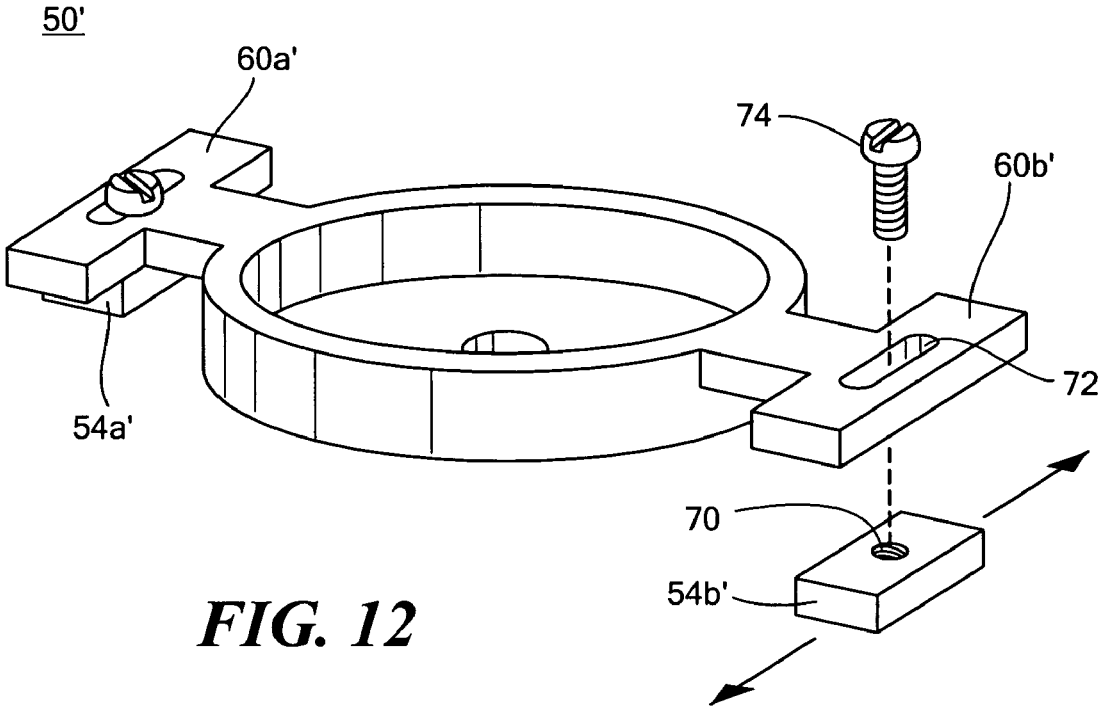
FIG. 12 is a schematic three-dimensional front view showing another embodiment of an adjustable valve guide in accordance with the subject invention.

In another embodiment, adjustable valve guide 50', FIG. 12 includes keys 54*a'* and 54*b'* movable relative to stop members 60*a'* and 60*b'* by virtue of threaded hole 70 in key 54*b'*, clearance hole 72 in stop member 60*b'*, and fastener 74 which seats on stop member 60*b'*. Key 54*b'* is adjusted in position relative to stop member 60*b* by loosening fastener 74 and secured to the stop member when alignment is completed by tightening fastener 74.

Figure 13A:
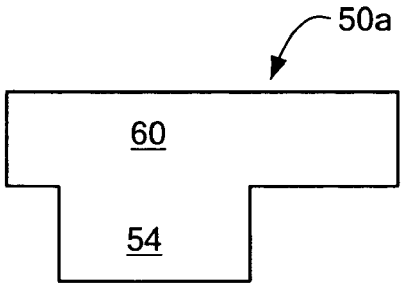
FIGS. 13A-13C are schematic views showing three different valve guides with different key orientations in accordance with the subject invention.
Figure 13B:
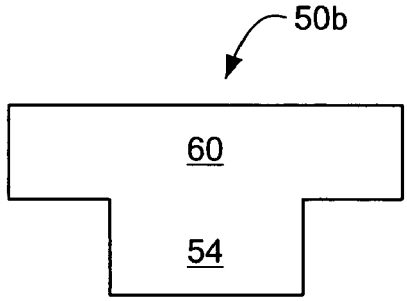
Figure 13C:
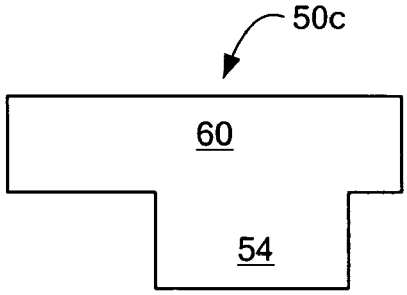

In still another embodiment, there are a selection of valve guides 50*a*-50*b*, FIGS. 13A-13B each with a different orientation of key 54 relative to stop member 60. Valve guide 50*a* has a left oriented key, valve guide 50*b* has a centered key, and valve guide 50*c* has a right oriented key. The manufacturer or valve adjuster thus chooses the appropriate key to properly align the valve in the instrument casing.

Figure 14:
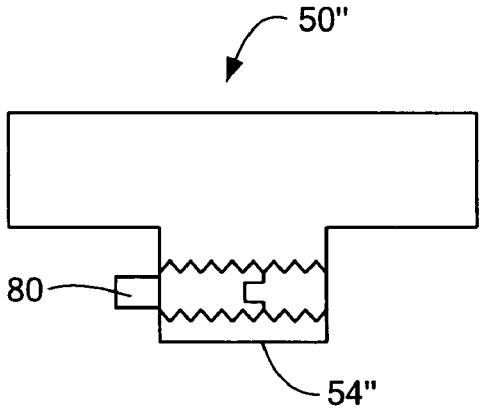
FIG. 14 is a schematic view showing an embodiment of an adjustable valve guide in accordance with the subject invention with a variable width key portion.
Figure 15:
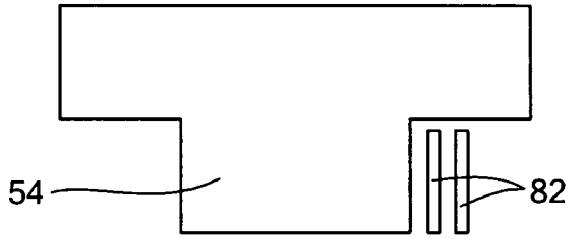
FIG. 15 is a schematic view of another embodiment of the subject invention wherein shims are used to vary the width of the key of the valve guide.
Figure 16:
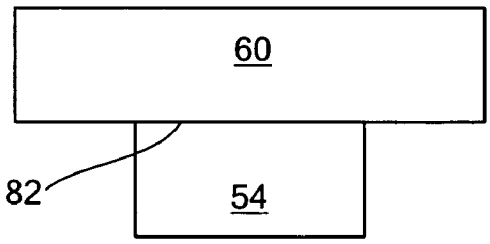
FIG. 16 is a schematic view of still another embodiment of an adjustable valve guide in accordance with the subject invention where the key and the stop member are initially separate pieces and glued together after valve adjustment.
Figure 17:
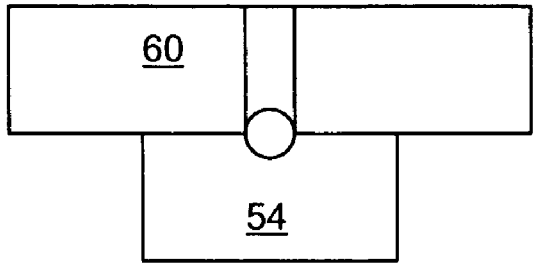
FIG. 17 is a schematic view of still another embodiment of an adjustable valve guide in accordance with the subject invention wherein the key and stop member portions of the valve guide are initially separate and then laser welded together after valve alignment.

Adjustable valve guide 50", FIG. 14 includes key 54" with fastener 80 extending outward therefrom and adjustable to change the effective width of key 54". Fastener 80 can also be driven to extend outward from the other side of key 54". In a related embodiment, shims 82, FIG. 15 are used to adjust the effective width of key 54. In another embodiment, key 54, FIG. 16 is initially separate from and thus adjustable relative to stop member 60 but, after alignment, the key is glued to the stop member at joint region 82. Or, as shown in FIG. 17, key 54 can be laser welded to stop member 60 after alignment.

Figure 18:
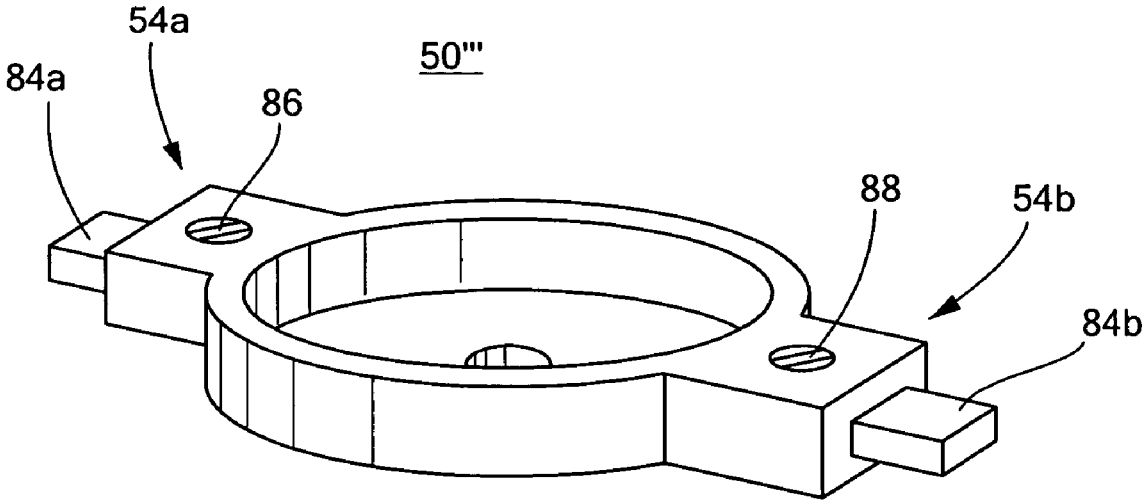
FIG. 18 is a schematic three-dimensional front view of still another embodiment of an adjustable valve guide in accordance with the subject invention with extensible and retractable key members.

In still another embodiment, adjustable valve guide 50''', FIG. 18 includes valve casing keys 54*a* and 54*b* with radially extensible and retractable portions 84*a* and 84*b* extended and retracted by mechanisms 86 and 88 to lock against the valve casing wall after valve adjustment.

Figure 19:
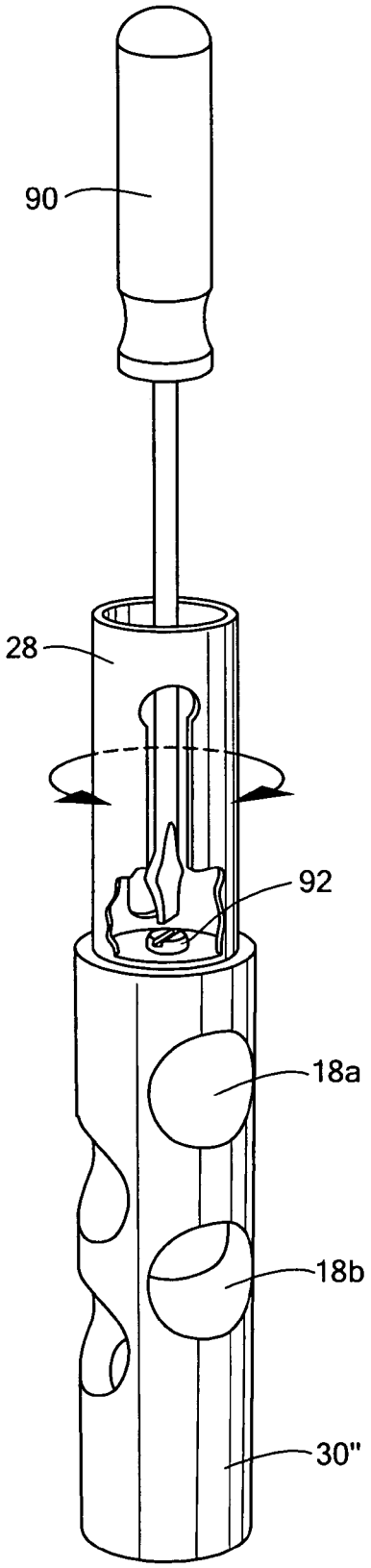
FIG. 19 is a schematic three-dimensional front view showing an embodiment of the subject invention wherein the valve barrel is adjustable with respect to the piston.
Figure 20:
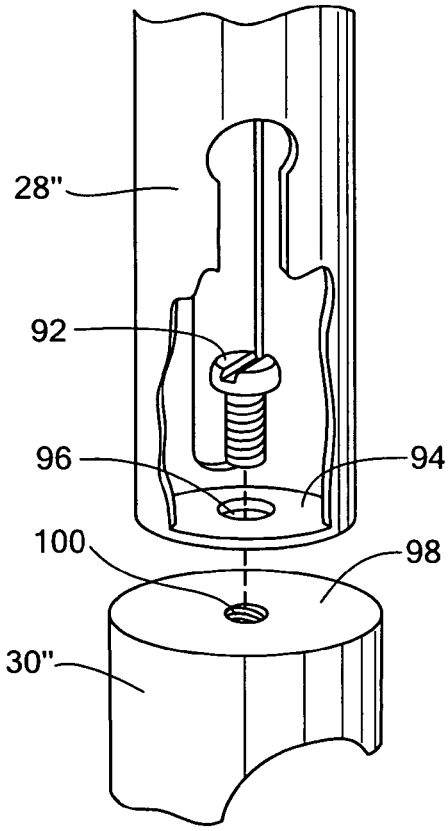
FIG. 20 is a schematic partial three-dimensional view showing how a fastener is used to secure the valve barrel shown in FIG. 19 to the piston.

FIGS. 19-20 show another example of valve barrel 28" itself adjustable (rotatable) with respect to piston 30" using screwdriver 90 to loosen screw 92 to rotate valve barrel 28" in-situ in the valve casing relative to piston 30". The bottom plate 94, FIG. 20 of barrel 28" includes clearance hole 96 through which fastener 92 extends and seats. Top plate 98 of piston 30" includes threaded hole 100 which receives fastener 92. In this way, the valve barrel is secured to the piston at a predetermined angular orientation with respect to the piston and that orientation can be adjusted, if necessary, to ensure proper valve alignment with the slide.

Figure 21:
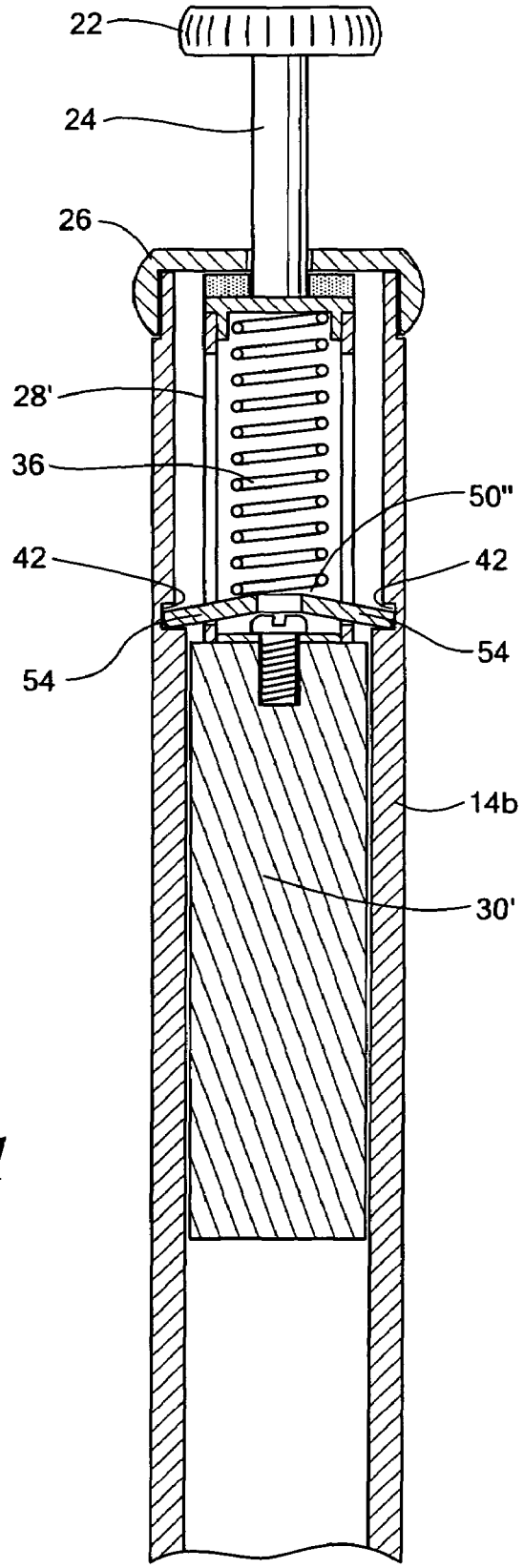
FIG. 21 is a schematic view showing another valve assembly with an adjustable valve guide.

In another embodiment, the monolithic valve barrel/piston assembly of FIG. 10 is shown in place in valve casing 14*b*, FIG. 21 and adjustable valve guide 50" includes keys 54 actuated by fastener 110 threaded into a hole tapped in the base of barrel 28'. The valve is held in the proper aligned position and fastener 110 is tightened to drive keys 54 radially outward to engage in slots 42 in casing 14*b* and lock into place therein to fix the radial and vertical position of the piston valve in casing 14*b*.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A musical instrument piston valve receivable in a valve casing with at least one valve guide key slot, the piston valve comprising:

a valve barrel including at least one slot of a predetermined width;

a piston extending from the valve barrel and including one or more ports;

the valve barrel and the piston monolithic in construction; and a rotatably adjustable valve guide within the valve barrel, the rotatably adjustable valve guide including:

a first plate including at least a first key received in said valve barrel slot and having a width the same as or approximately the same as the predefined width of the valve barrel slot;

a second plate rotatable with respect to the first plate, the second plate having at least a second key received in said valve barrel slot and having a width less than the predefined width of the valve barrel slot, and one of said first and second keys received in said valve casing valve guide key slot.

2. The piston valve assembly of claim 1 in which said first plate is a top plate and said second plate is a bottom plate and each plate has opposing keys.

3. The piston valve assembly of claim 2 in which said bottom plate keys are received in valve casing valve guide key slots.

4. The piston valve assembly of claim 1 in which the adjustable valve guide further includes a fastener adjustably securing the first plate to the second plate.

* * * * *